US008015956B2

(12) United States Patent
Gaiser et al.

(10) Patent No.: US 8,015,956 B2
(45) Date of Patent: Sep. 13, 2011

(54) PISTON ASSEMBLY FOR BARREL ENGINE

(75) Inventors: Randall R. Gaiser, Chelsea, MI (US); Michael Hold, Dechantskirchen (AT)

(73) Assignee: Thomas Engine Company, LLC, Boulder, CO (US)

( * ) Notice: Subject to any disclaimer, the term of this patent is extended or adjusted under 35 U.S.C. 154(b) by 728 days.

(21) Appl. No.: 11/916,624

(22) PCT Filed: Jun. 9, 2006

(86) PCT No.: PCT/US2006/022795

§ 371 (c)(1), (2), (4) Date: Jul. 15, 2008

(87) PCT Pub. No.: WO2006/133452

PCT Pub. Date: Dec. 14, 2006

(65) Prior Publication Data

US 2009/0145377 A1 Jun. 11, 2009

Related U.S. Application Data

(63) Continuation of application No. 11/449,245, filed on Jun. 8, 2006, now abandoned.

(60) Provisional application No. 60/688,831, filed on Jun. 9, 2005, provisional application No. 60/773,729, filed on Feb. 15, 2006.

(51) Int. Cl.
*F02B 75/18* (2006.01)

(52) U.S. Cl. ..... 123/56.1; 123/56.2; 123/56.8

(58) Field of Classification Search ..... 123/56.1–56.9
See application file for complete search history.

(56) References Cited

U.S. PATENT DOCUMENTS

| | | | |
|---|---|---|---|
| 344,593 | A | 6/1886 | Peabody |
| 349,775 | A | 9/1886 | Wood |
| 851,293 | A | 4/1907 | Lehberger |
| 892,804 | A | 7/1908 | Burbank |
| 928,715 | A | 7/1909 | Thurber |
| 1,063,456 | A | 6/1913 | Looney |
| 1,076,807 | A | 10/1913 | Anderson |
| 1,132,161 | A | 3/1915 | Cassady et al. |
| 1,177,609 | A | 4/1916 | Edwards |

(Continued)

FOREIGN PATENT DOCUMENTS

| | | |
|---|---|---|
| WO | WO-80/02438 A1 | 11/1980 |

(Continued)

*Primary Examiner* — Noah Kamen
(74) *Attorney, Agent, or Firm* — Gifford, Krass, Sprinkle, Anderson & Citkowski, P.C.; Douglas L. Wathen

(57) ABSTRACT

A barrel engine includes a central drive shaft and a cam plate interconnected to the drive shaft. The barrel engine includes a plurality of cylinders each having a longitudinal axis that is generally parallel with the drive shaft. The axes of the cylinders are arranged in a generally circular manner about the drive shaft. A pair of guide rods are provided, which correspond to each cylinder of the engine. Each guide rod has an axis generally parallel with the axes of the cylinders. The barrel engine includes a plurality of piston assemblies. Each piston assembly includes a piston head slidably coupled to one of the cylinders for reciprocal movement along the axis of the cylinder. Each piston assembly also includes a guide block slidably coupled to a respective pair of guide rods for guiding the piston head during reciprocal movement along the axis of the cylinder.

42 Claims, 14 Drawing Sheets

U.S. PATENT DOCUMENTS

| | | | | | |
|---|---|---|---|---|---|
| 1,181,463 | A | | 5/1916 | La Fontaine | |
| 1,183,470 | A | | 5/1916 | Lee | |
| 1,183,777 | A | | 5/1916 | Soules | |
| 1,352,985 | A | * | 9/1920 | Murphy | 123/56.8 |
| 1,466,144 | A | * | 8/1923 | Murphy | 123/56.8 |
| 2,118,804 | A | * | 5/1938 | Andersen | 123/56.7 |
| 2,320,526 | A | * | 6/1943 | Landis | 123/56.8 |
| 4,639,173 | A | | 1/1987 | Waller | |
| 4,979,406 | A | | 12/1990 | Waller | |
| 5,033,869 | A | | 7/1991 | Kingston et al. | |
| 5,362,154 | A | | 11/1994 | Wiesen | |
| 5,749,337 | A | | 5/1998 | Palatov | |
| 5,771,694 | A | | 6/1998 | Houtman et al. | |
| 2004/0163619 | A1 | | 8/2004 | Thomas | |

FOREIGN PATENT DOCUMENTS

| | | |
|---|---|---|
| WO | WO-03/093662 | 11/2003 |

* cited by examiner

PISTON ASSEMBLY FOR BARREL ENGINE

REFERENCE TO RELATED APPLICATIONS

This application is the U.S. national phase of PCT/US06/22795, filed Jun. 9, 2006, which claims priority to U.S. patent application Ser. No. 11/449,245, filed Jun. 8, 2006, now abandoned, and U.S. provisional patent application Ser. Nos. 60/688,831, filed Jun. 9, 2005, and 60/773,729, filed Feb. 15, 2006, the entire content of all of which are incorporated herein by reference.

FIELD OF THE INVENTION

The present invention relates to internal combustion engines and, more particularly, to a piston assembly for barrel type internal combustion engines.

BACKGROUND OF THE INVENTION

Within the general field of barrel-type engines, there exist two primary classes of engines: swashplate barrel engines and camplate barrel engines. The two classes of barrel engines can be distinguished by the properties of the drive mechanisms they employ to convert the reciprocating motion of the pistons into rotational motion of the driveshaft.

Swashplate barrel engines utilize a drive means that consists of an angled plate capable reciprocating the pistons through two cycles per one revolution of the driveshaft. A piston in a swashplate barrel engine generally communicates with the swashplate via a slipper pad in sliding contact with the surface of the swashplate or with a universal type joint attached to an annular ring in sliding contact with the surface of the swashplate. An example of a swashplate barrel engine is illustrated in FIG. 12.

Cam plate barrel engines utilize a drive means that consists of a plate with an undulating cam surface normally capable of reciprocating the pistons through four or more cycles per one revolution of the driveshaft. A piston in a swashplate barrel engine generally communicates with the camplate via a pair of rolling elements that follow the undulating surface of the camplate.

In both swash plate barrel engines and camplate barrel engines, high side loads exist at the point where the pistons communicate with the angled surfaces of the swashplate or camplate. This side loading must be reacted somewhere within the piston apparatus without generating unacceptably high levels of friction and wear.

In the field of camplate barrel engines, very little progress has been made to reduce the friction forces that result from side loading within the piston apparatus. As a result, the friction generated in camplate barrel engines can be as much as 70% higher than a conventional crankshaft driven engine, having a negative impact on fuel economy and limiting the adoption of these engines. Several attempts have been made to isolate side loads from the piston skirts in camplate barrel engines. Various versions of guide rod strategies have been proposed. However, to date, there has yet to be a structurally viable example of a guide rod/piston assembly in a camplate barrel engine.

One design that seeks to address the side loading issue is shown in U.S. Pat. No. 5,771,694, which is illustrated in FIGS. 13A and 13B. The '694 reference discloses a double guide rod mechanism which guides the piston during its reciprocating motion in the cylinder. The side loads are generally carried by the guide rods at the swashplate interface instead of the piston skirts, thereby resulting in an overall reduction in friction and increased engine efficiency over an unguided system. However, FIG. 14 illustrates another double guide rod apparatus as proposed in U.S. Pat. No. 4,553,508 to Stinebaugh. In this design, the attachment of the camplate rollers to the piston apparatus will not survive under normal engine operation. At as low as 3000 RPM, the inertial forces transferred through the roller pins in camplate barrel engines are on the order of 12,000 to 15,000 pounds. Under these forces, a camplate roller pin supported on only one end will break.

FIG. 15 illustrates another guide rod apparatus as proposed in U.S. Pat. No. 1,063,456 to Looney. In this design, only one guide rod is used to handle side loads from the piston apparatus. To prevent rotation of the piston apparatus, an extension is provided on the backside of the guide rod bearing which slides within a track in the engine block. Similar to the design proposed in U.S. Pat. No. 4,553,508, the cam plate roller pins are only supported on one end. This design as shown will not withstand the conditions associated with normal engine operation.

FIG. 16 illustrates a square guide apparatus as proposed in U.S. Pat. No. 5,566,578 to Rose. In this design, the piston apparatus itself slides within a square slot that receives the side loads from the camplate rollers. This design is also flawed because the camplate rollers are supported on only one end.

FIG. 17 illustrates an additional style of guide apparatus as proposed in PCT/BG97/00005 to Bahnev that includes slots in the piston apparatus. The slots in the piston apparatus engage linear bearings attached to the block. This design also uses camplate rollers with the pin supported on one end and will also fail under normal engine operation.

Thus, FIGS. 13-17 illustrate guide rod mechanisms that have been proposed. It will be evident to one who is skilled in the art that none of these mechanisms will survive within the operating environment of an internal combustion engine. Therefore, it remains desirable to provide an improved guide system that overcomes the inherent weaknesses of conventional guide systems.

SUMMARY OF THE INVENTION

According to one aspect of the invention, a barrel engine includes a drive shaft; a cam plate interconnected to the drive shaft; a plurality of cylinders, each having a longitudinal axis that is generally parallel with the drive shaft, the axes of the cylinders being arranged in a generally circular manner about the drive shaft; a pair of guide rods corresponding to each cylinder of the engine, each rod having an outer surface extending longitudinally along an axis generally parallel with the axes of the cylinders; and a plurality of piston assemblies each comprising: a piston head slidably coupled to one of the cylinders for reciprocal movement along the axis of the cylinder; a pair of roller bearings rollingly engaged with opposite surfaces of the cam plate to cause rotation of the drive shaft in response to the axial movement of the piston head; a bridge structure having a center portion and a connecting rod extending therefrom to support the piston head, the center portion extending between a pair of spaced apart bearing supports, each bearing support having an outer wall generally parallel with the center portion and an end wall interconnecting the center portion to the outer wall; a pair of pivot pins each pivotally connecting one of the roller bearings to one of the bearing supports, each pivot pin having one end fixedly secured to the center portion and an opposite end fixedly secured to the outer wall, the pivot pin being a member of a substantially closed-ended structure defined by the center portion, end wall and outer wall to minimize flexing of the bearing support relative to the center portion; and a guide block interconnected to the bridge structure, the guide block further having inner walls defining a pair of bores, each of the bores slidably receiving the guide rod therethrough for guiding the piston head during reciprocal movement along the axis of the cylinder, each inner wall being spaced apart from the outer surface of a respective guide rod to define an oil reservoir therebetween, the oil reservoir extending generally continuously between opposite ends of the guide block.

According to another aspect of the invention, a piston assembly is provided for use in a barrel internal combustion engine having a central drive shaft, a cam plate fixedly secured to the drive shaft for rotation therewith, and a plurality of cylinders radially spaced apart from the drive shaft. The piston assembly includes a piston head slidably coupled to one of the cylinders for reciprocating axial movement therein; a pair of roller bearings rollingly engaged with opposite surfaces of the cam plate to cause rotation of the drive shaft in response to the axial movement of the piston head; a bridge structure having a center portion and a connecting rod extending therefrom to support the piston head, the center portion extending between a pair of spaced apart bearing supports, each bearing support having an outer wall generally parallel with the center portion and an end wall interconnecting the center portion to the outer wall; and a pair of pivot pins each pivotally connecting one of the roller bearings to one of the bearing supports, each pivot pin having one end fixedly secured to the center portion and an opposite end fixedly secured to the outer wall, the pivot pin being a member of a substantially closed-ended structure defined by the center portion, end wall and outer wall to minimize flexing of the bearing support relative to the center portion.

According to another aspect of the invention, a barrel engine includes a drive shaft; a cam plate interconnected to the drive shaft; a plurality of cylinders, each having a longitudinal axis that is generally parallel with the drive shaft, the axes of the cylinders being arranged in a generally circular manner about the drive shaft; a pair of guide rods corresponding to each cylinder of the engine, each rod having an outer surface extending longitudinally along an axis generally parallel with the axes of the cylinders; and a plurality of piston assemblies each comprising: a piston head slidably coupled to one of the cylinders for reciprocal movement along the axis of the cylinder; a guide block operatively coupled to the cam plate to cause axial displacement of the piston head in the cylinder in response to rotation of the cam plate with the drive shaft, the guide block further having inner walls defining a pair of bores, each of the bores slidably receiving the guide rod therethrough for guiding the piston head during reciprocal movement along the axis of the cylinder, each inner wall being spaced apart from the outer surface of a respective guide rod to define an oil reservoir therebetween, the oil reservoir extending generally continuously between opposite ends of the guide block.

DETAILED DESCRIPTION OF THE PREFERRED EMBODIMENTS

The present invention provides a piston assembly with a crosshead guide system for use in a barrel-type internal combustion engine. A barrel engine includes a central drive shaft and an undulating cam plate extending therefrom for rotation therewith. A plurality of cylinders is arranged about the central power shaft. A plurality of piston assemblies are provided with piston heads slidably engaged within respective cylinders in the engine. The pistons reciprocate due to combustion of a fuel/air charge in the cylinders. The piston assemblies are engaged with the cam plate, so that the reciprocal movement of the piston assemblies is translated into rotational movement of the cam plate and drive shaft. Described in greater detail below, the guide system utilizes a pair of guide rods for guiding the reciprocal motion of each piston assembly.

Figure 1:
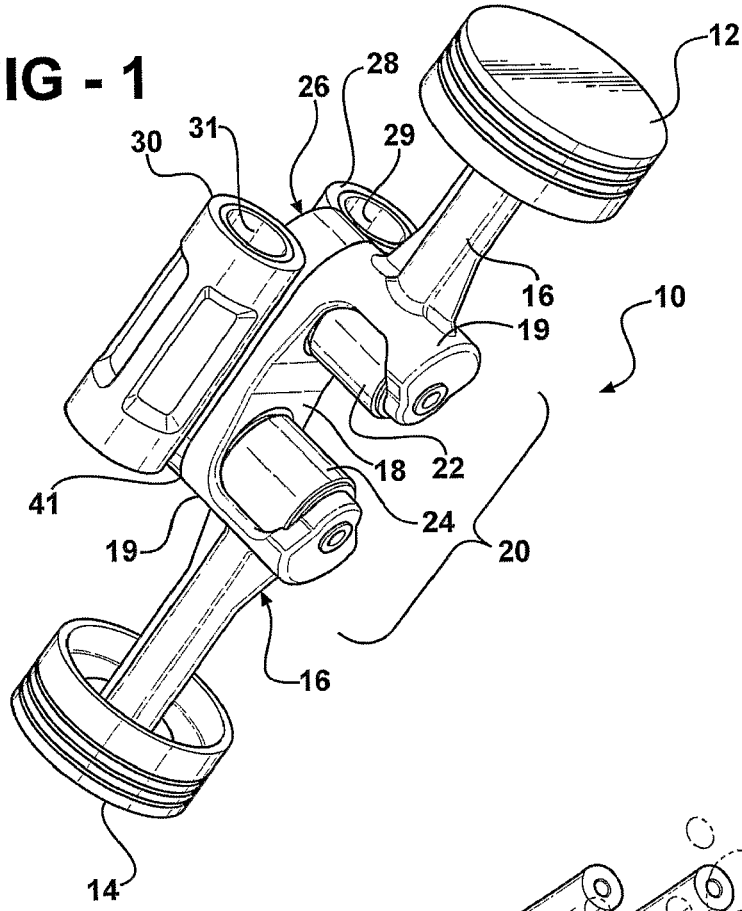
FIG. 1 illustrates a piston assembly for use in a barrel internal combustion engine according to one embodiment of the invention.
Figure 2:
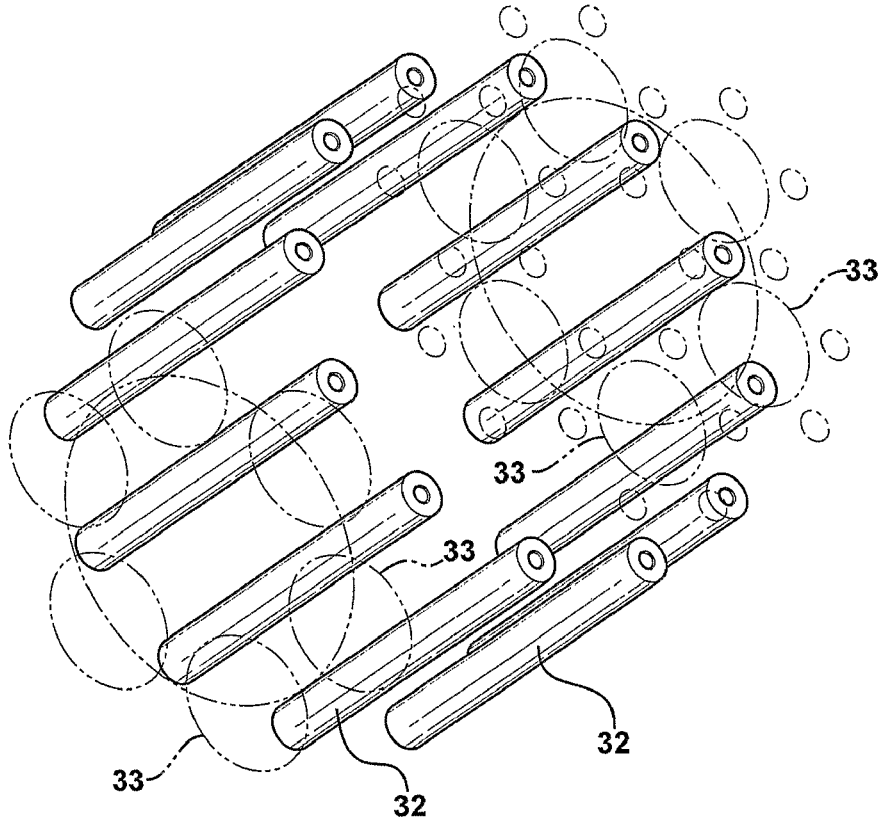
FIG. 2 illustrates an array of guide rods for guiding the piston assemblies.

Referring to FIG. 1, a piston assembly is generally indicated at 10 for use in a double-ended barrel engine. The piston assembly 10 includes a bridge structure 20. A pair of connecting rods 16 extends outwardly from opposite sides of the bridge structure 20. A pair of pistons 12, 14 is fixedly secured to the pair of connecting rods 16. The pistons 12, 14 are arranged in a symmetrically opposite orientation relative to each other.

Figure 3:
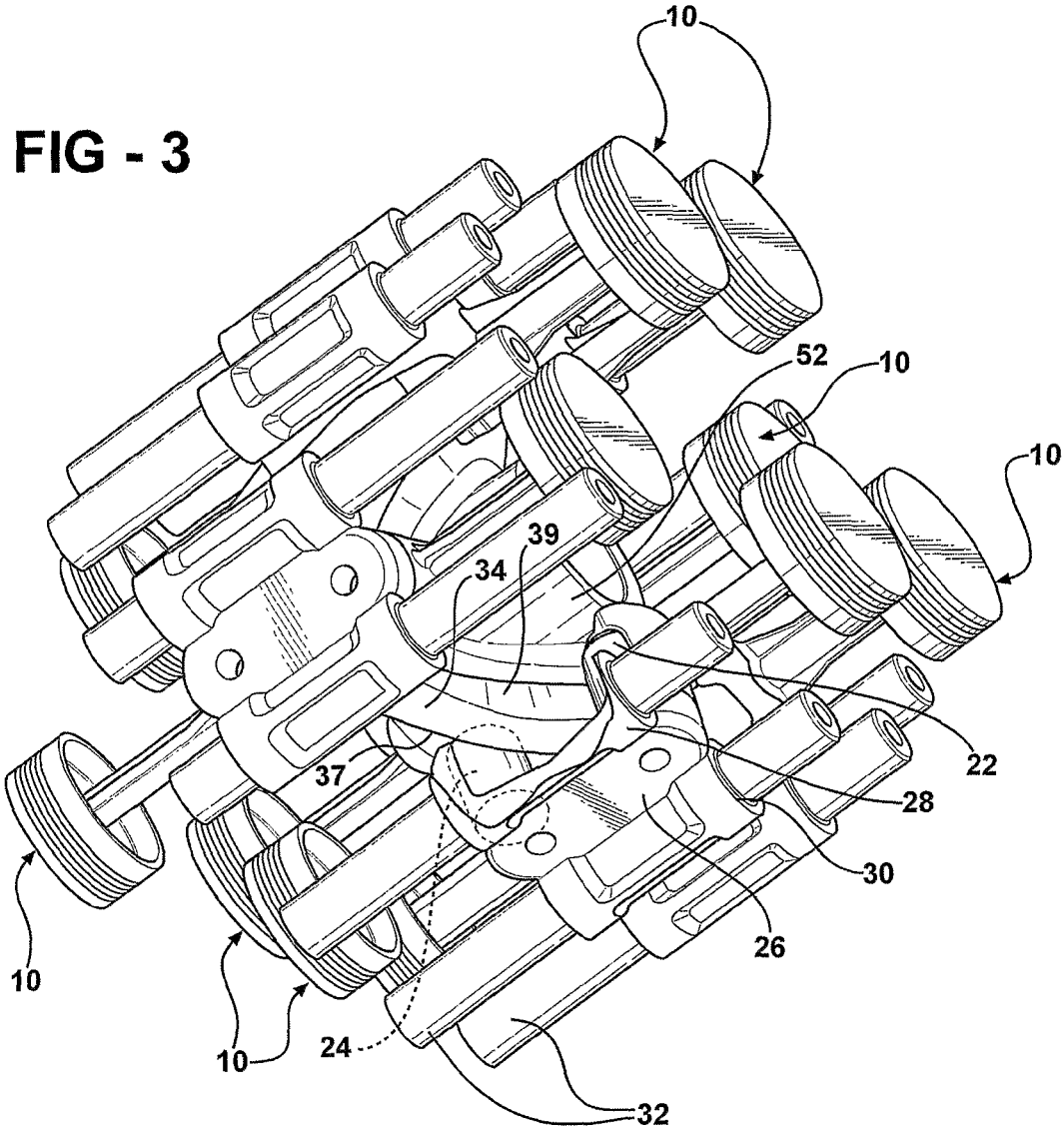
FIG. 3 is a perspective view of a portion of a barrel engine, showing the array of guide rods, a cam plate, and six piston assemblies engaging the guide rods and the cam plate.
Figure 4:
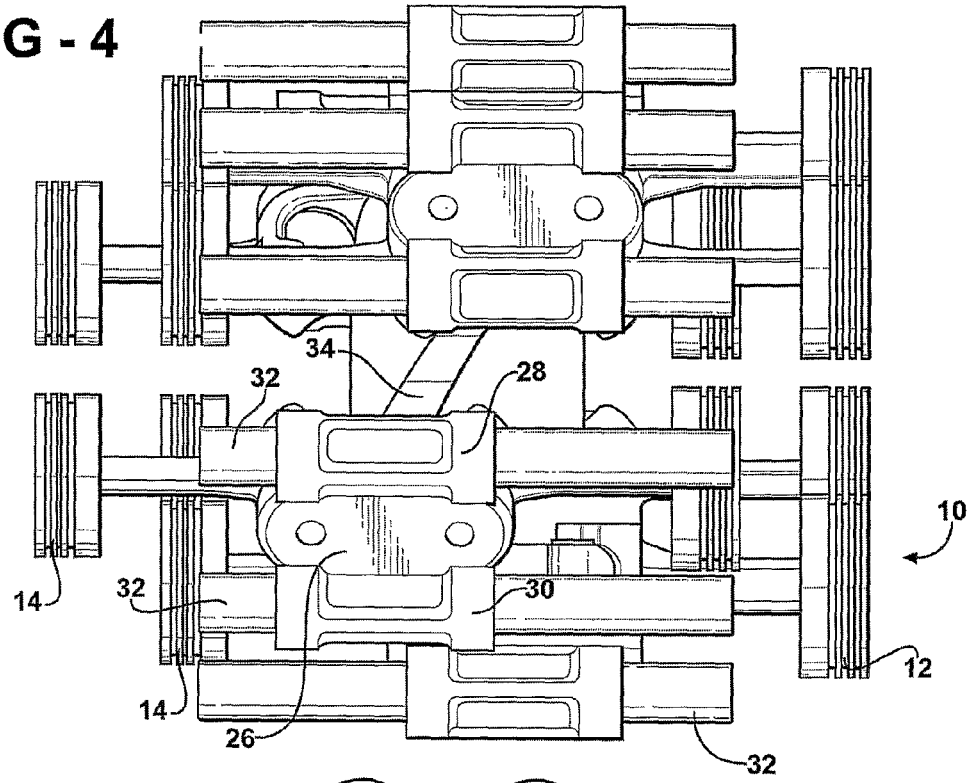
FIG. 4 is a side elevational view of the portion of the barrel engine of FIG. 3.
Figure 5:
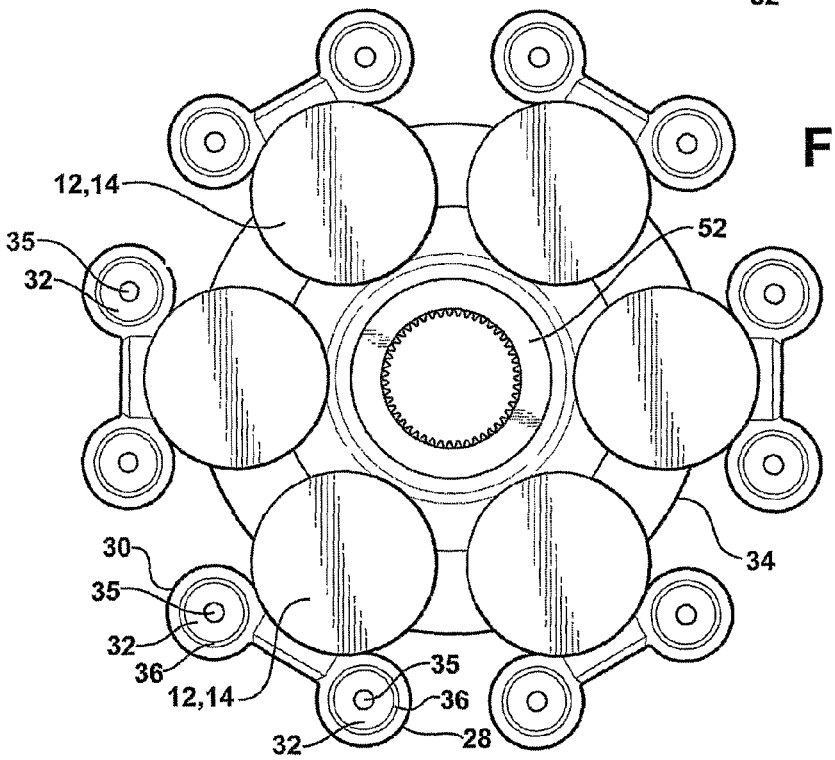
FIG. 5 is an end view of the portion of the barrel engine of FIGS. 3 and 4.
Figure 6:
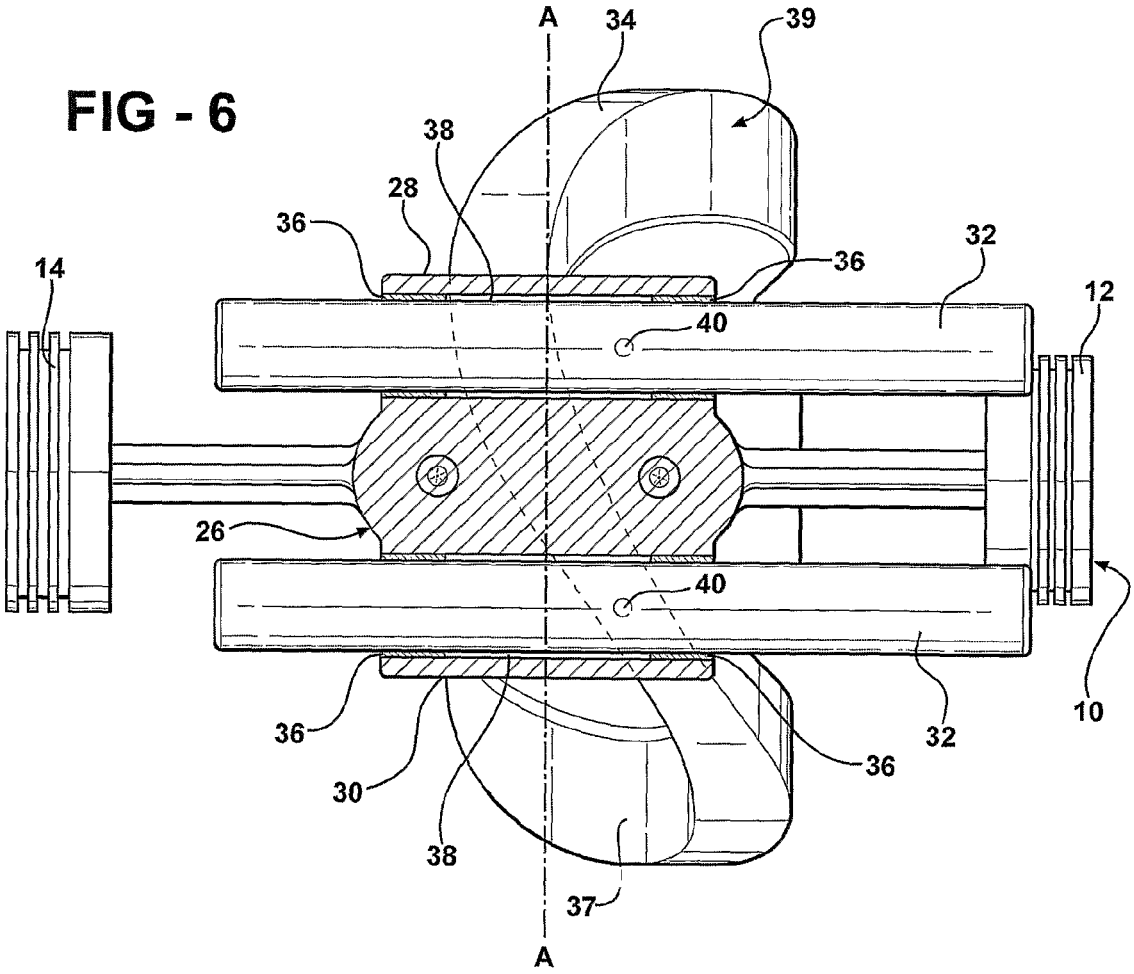
FIG. 6 is a view of a single piston assembly engaging a cam plate and a pair of guide rods, with the guide rod bearing portion of the piston assembly being cut away.

The bridge structure 20 includes a center portion 18 and a pair of opposing bearing supports 19, which are disposed on opposite ends of the center portion 18. Each of a pair of roller bearings 22, 24 is rotatably coupled to a respective bearing support 19 by a pivot pin. The bearings 22, 24 are rollingly engaged on opposite upper 37 and lower 39 surfaces of the undulating cam plate 34 in the barrel engine (as shown in FIGS. 3 and 6). As should be clear to those of skill in the art, the roller bearings 22, 24 may experience very high forces in an operating engine. Thus, both ends of each pivot pin supporting the bearings 22, 24 are supported in the bearing support 19 so that they are not cantilevered. The roller bearings 22, 24 may be formed of a ceramic material to reduce the reciprocating weight of the piston assembly 10. Alternatively, other types of rollers, bearings or materials may be used between the bridge structure and the cam plate during operation of the engine.

A cross head guide block 26 is fixedly secured to the bridge structure 20 for slidably coupling the piston assembly 10 to the guide rods 32. More specifically, the guide block 26 includes a pair of spaced apart crosshead guide rod bearing supports 28, 30, each having cylindrically-shaped bores 29, 31 for slidably receiving a guide rod 32 therethrough. By this arrangement, each piston assembly 10 is guided by a respective pair of guide rods 32, which are supported in the bores 29, 31 in the guide block 26. The guide rods 32 are shown as being cylindrically shaped having a circular in cross section. It should, however, be readily appreciated that the guide rods and corresponding bores may have other cross sectional shapes, such as oval or square, so long as the guide rods extend in a longitudinal manner to guide the reciprocating motion of the pistons within the cylinders.

Referring to FIGS. 2-5, an exemplary six-cylinder barrel engine utilizes six pairs of guide rods 32 for guiding as many piston assemblies 10. The guide rods 32 are arranged generally in a circle and spaced radially outwardly from the cylinders (shown in phantom lines and indicated at 33 in FIG. 2). The roller bearings 22, 24 of each of the piston assemblies 10 are rollingly engaged to opposing sides of the cam plate 34.

Figure 11:
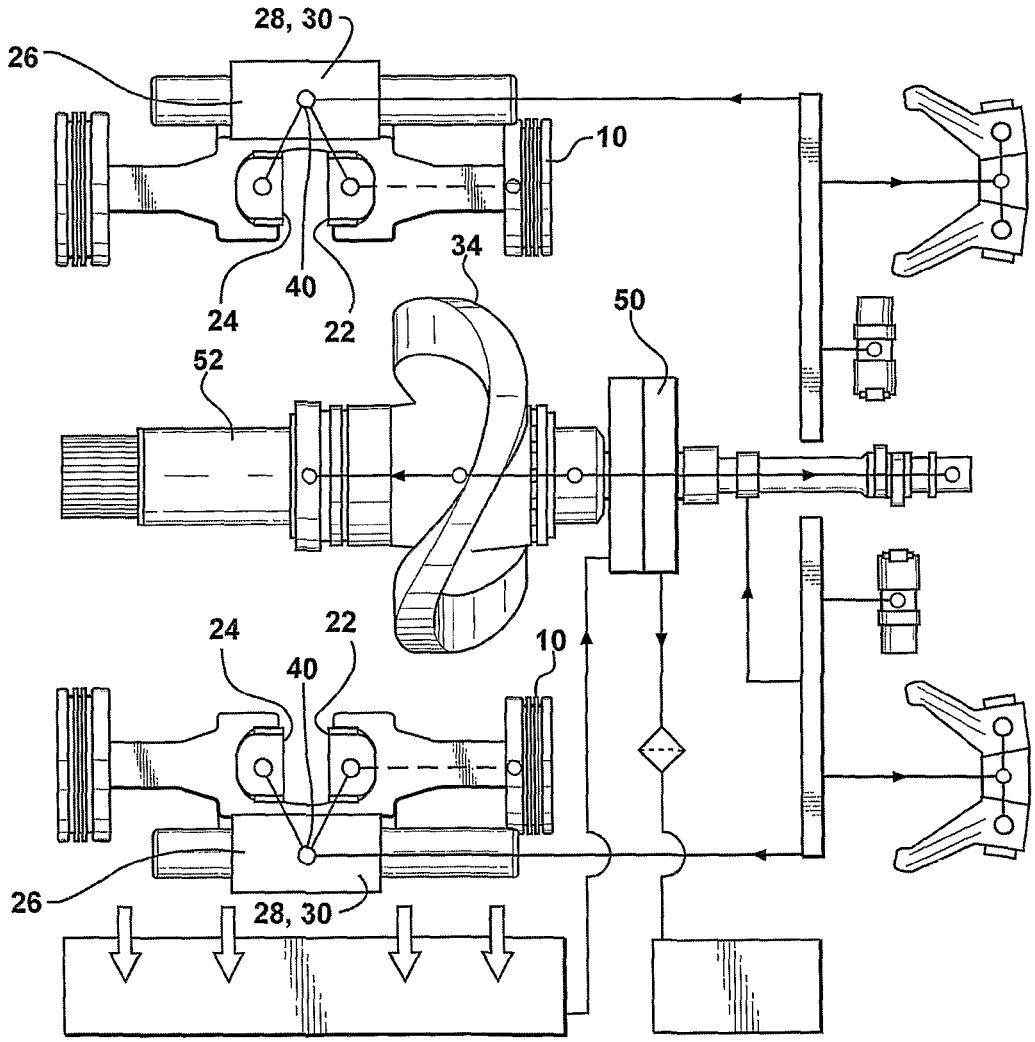
FIG. 11 is a schematic view of the barrel engine illustrating the delivery of oil to various areas of the engine.
Figure 12:
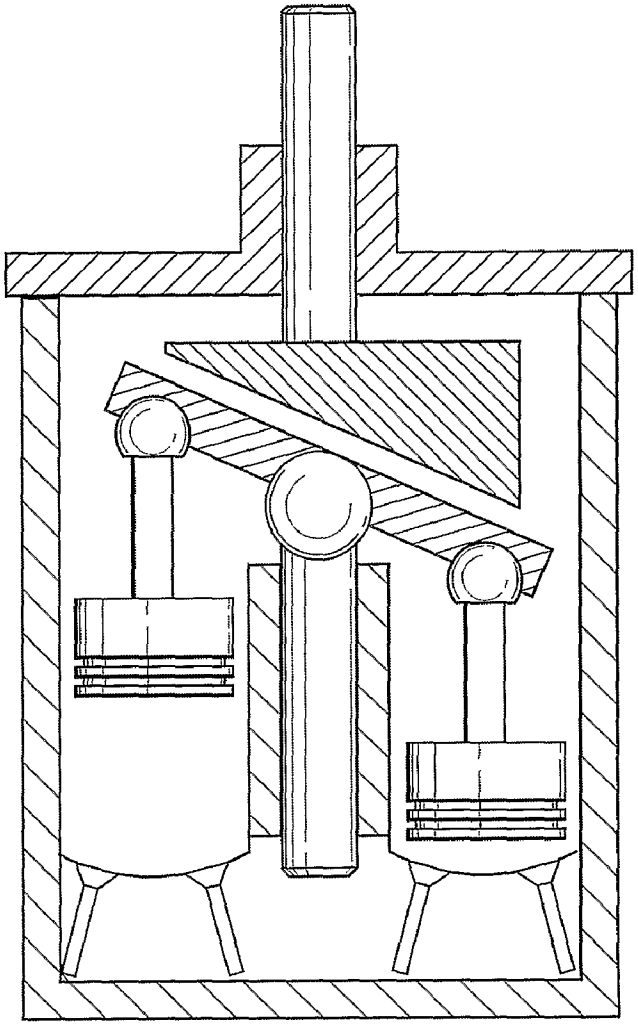
FIG - 12 PRIOR ART
FIG. 12 illustrates an example of a swashplate barrel engine.
Figure 13A:
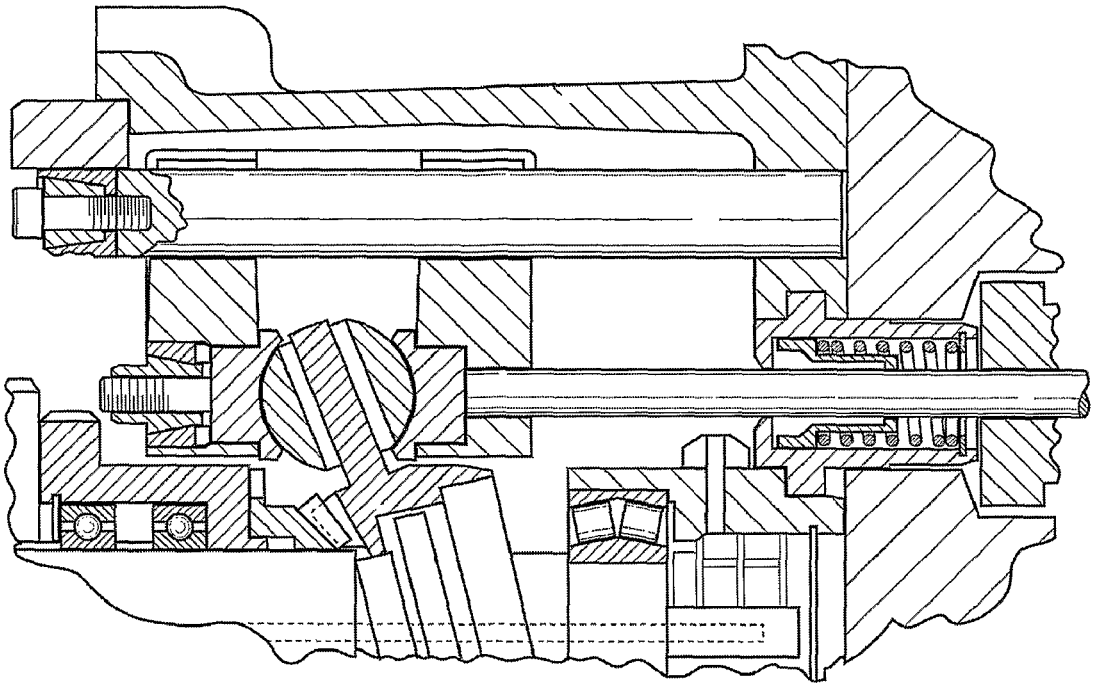
FIG - 13A PRIOR ART
FIGS. 13A and 13B illustrate examples of a camplate barrel engine.
Figure 13B:
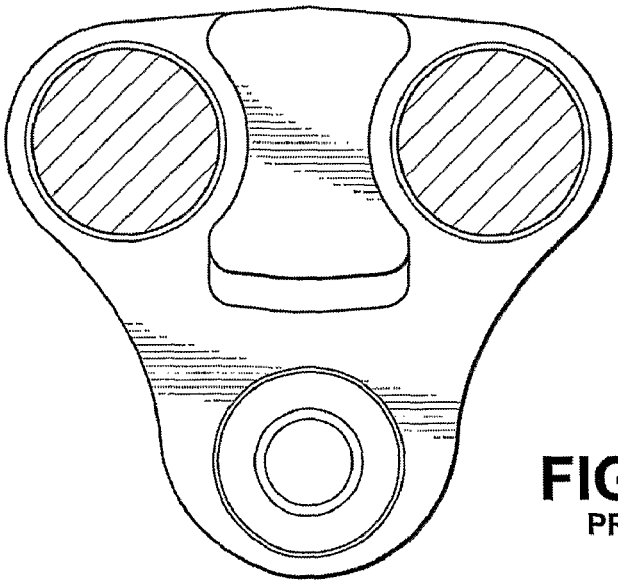
FIG - 13B PRIOR ART
Figure 14:
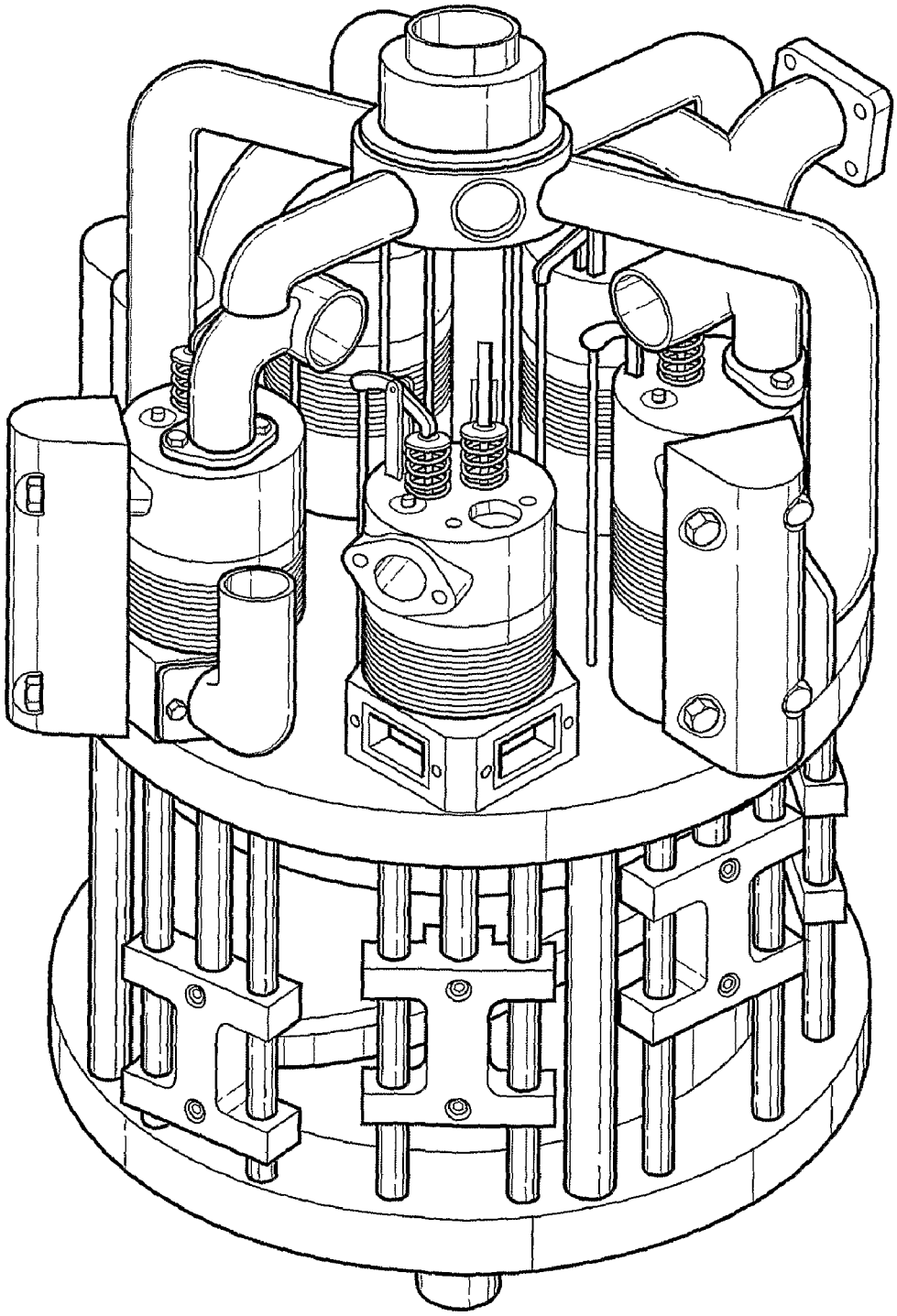
FIG - 14 PRIOR ART
FIG. 14 illustrates portions of a double guide rod crosshead mechanism found in U.S. Pat. No. 5,771,694.
Figure 15:
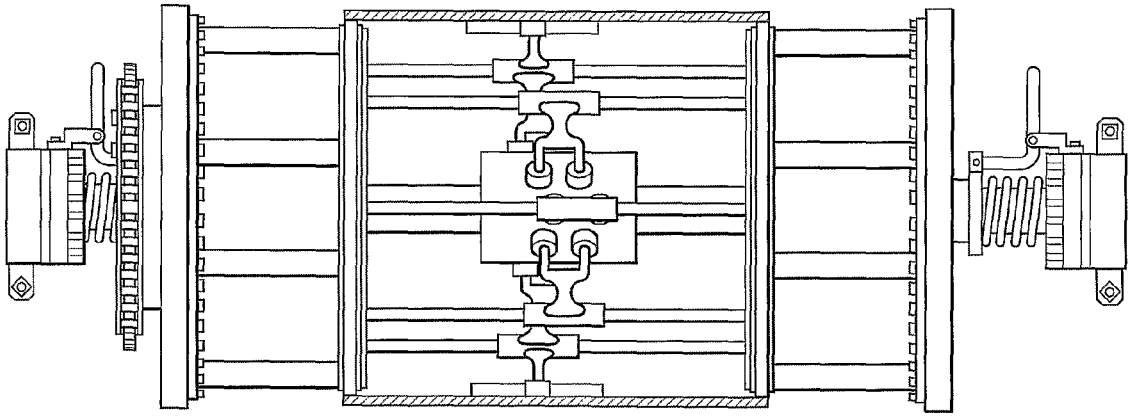
FIG - 15 PRIOR ART
FIG. 15 illustrates a guide rod apparatus as disclosed in U.S. Pat. No. 1,063,456.
Figure 16:
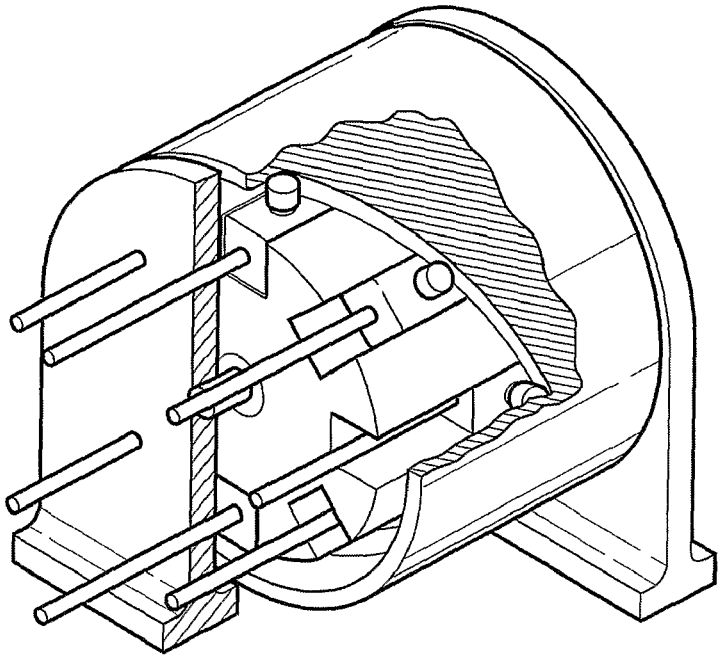
FIG - 16 PRIOR ART
FIG. 16 illustrates a square guide apparatus as proposed in U.S. Pat. No. 5,556,578.
Figure 17:
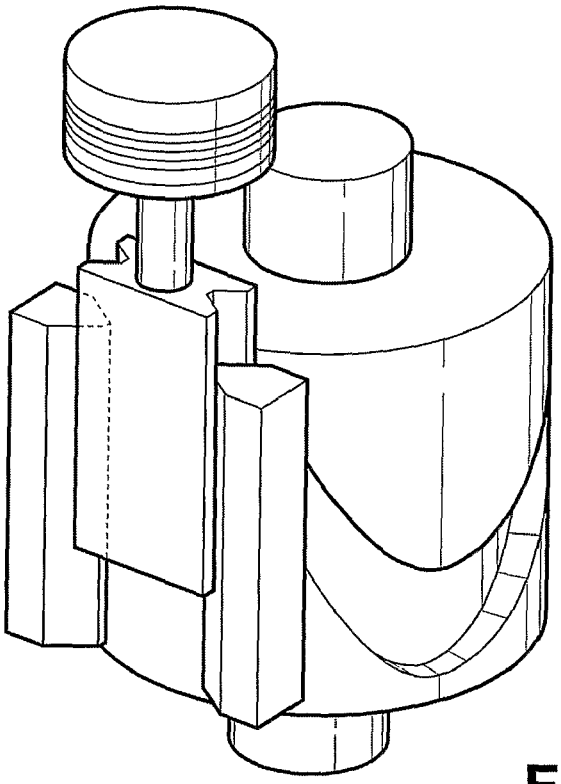
FIG - 17 PRIOR ART
FIG. 17 illustrates a guide apparatus as proposed in PCT/BG97/00005.

In FIG. 6, the guide block 26 is cut away to show the sliding engagement of the guide rods 32 in the bores 29, 31 (FIG. 1) of the guide rod bearing supports 28, 30. Bearings or bushings 36 are provided at each end of the bores 29, 31 (FIG. 1) for slidably supporting the guide rods 32 in the guide block 26. The bushings 36 are axially spaced apart. An annular shaped oil cavity 38 is defined between the bushings 36 and between the outer surface of the guide rods 32 and the inner walls of the supports 28, 30 that define the bores 29, 31 (FIG. 1). In one embodiment of the invention, oil passages 35 extend through the guide rods 32 and are in communication with holes 40 that lead to the exterior surface of the guide rods 32. These holes 40 provide pressurized oil to the annular cavities 38 and thereby provide pressurized oil to the bushings 36. As shown in FIG. 11, the pressurized oil may be provided by an oil pump 50 driven coaxially by the central drive shaft 52. The supports 28, 30 and bushings 36 are positioned and dimensioned such that the holes 40 are always disposed in fluid communication with the cavities 38 during the reciprocal movement of the piston assemblies 10.

In order to minimize reciprocating weight, the guide block 26 is preferably as small as possible and yet be sufficiently long so as to house the bushings 36 and prevent the hole 40 from being uncovered during the entire stroke of the piston assemblies 10. As will be clear to those of skill in the art, the fact that the bushings 36 are spaced apart also allows them to resist higher loads that attempt to bend or twist the piston assembly 10.

A barrel engine may utilize a variable compression ratio device for adjusting the axial position of the cam plate 34 within the engine relative to the position as shown in FIG. 6. In barrel engines utilizing a variable compression ratio device, the minimum length of the guide rod bearing supports 28, 30 is equal to the engine stroke plus the maximum variable compression displacement plus the length of one of the bushings 36. It is preferred that the length of the supports 28, 30 be kept close to this minimum. For example, the range may be from 0 to 10% over this minimum length, though 0 to 20% or 0 to 30% ranges may be used. In one exemplary embodiment, the stroke of the engine is 76 millimeters, the maximum variable compression ratio displacement is 6½ millimeters, and the length of one bearing is 20 millimeters. This provides a minimum length for the supports 28, 30 of 102.5 millimeters. As will be clear to those of skill in the art, this minimum length means that the hole 40 is sometimes positioned directly under one of the bushings 36. If it is desired to have the hole 40 communicate only with the annular cavity 38, the length of the housing 28 or 30 must be increased by the length of an additional bearing. In the above example, this would increase the length to 122.5 millimeters. In versions of a barrel engine without a variable compression ratio device, the minimum length is equal to the stroke plus the length of one bearing. In the above example, this would give a minimum length of 96 millimeters. Again, a range of 0 to 10% over this length may be preferred, with 0 to 20% or 0 to 30% being possible for some applications.

Referring back to FIG. 1, a parting line 41 is shown between the guide block 26 and the bridge structure 20. In some embodiments, the guide block 26 is made of a separate material and then fixedly secured to the bridge structure 20. This allows the guide block 26 to be attached to the bridge structure 20 after partial assembly of the engine. The connection of the guide block 26 and structure 20 may be accomplished in a variety of ways, as will be clear to those of skill in the art. In other embodiments, the guide block 26 and bridge structure 20 are integrally formed. With either approach, the piston assembly 10 may be split into two halves, such as along line A-A in FIG. 6. The two halves may then be rejoined during assembly of the engine either by bolting or by other means, including bonding, welding, and other approaches known to those of skill in the art. The splitting may be by cutting or the bridge structure and/or guide block may be cracked in a manner similar to the cracking done during the formation of conventional connecting rods. The area where the split or crack is formed may be considered a frangible parting line or area. By splitting the piston assembly 10 into two or more pieces, some clearance adjustments may be made during assembly. The splitting also allows the engine to be more easily assembled. The upper portion can be assembled to the guide rods, the cam plate may be positioned, and then the lower portion can be assembled to the guide rods and joined to the upper portion, thereby trapping the cam plate therebetween. While the parting line A-A is illustrated as approximately half way between the upper and lower bearing supports and perpendicular to the cylinder axis, it may be positioned higher or lower, and/or at an angle to the illustrated parting line. For example, it may be angled side to side, with respect to FIG. 1, or it may be angled front to back or back to front with respect to the Figure.

Several alternatives are encompassed within the scope of the present invention. For example, oil pressure and flow may be provided from only one of the pairs of guide rods 32 to one of the cavities 38 defined in the guide block 26, with oil being fed from there to the other of the cavities 38 in the guide block 26. Optionally, oil pressure may be fed from these cavities 38 to the roller bearings 22, 24. As yet a further alternative, oil jets may be provided to direct some of the oil from the cavities 38, or from elsewhere, onto the surface of the cam plate 34 and/or onto the bottom of the pistons 12, 14 to provide for cooling and lubrication. Oil may also be provided to these areas in other ways.

As will be clear to those of skill in the art, the guide block 26 in cooperation with the guide rods 32 react side loads and twisting loads that would otherwise be experienced by the pistons 12, 14. In a typical internal combustion engine, the pistons themselves must react significant side loads in order to maintain the piston in a proper alignment within the cylinder. For this purpose, pistons typically have side skirts which extend downwardly from the top of the piston and include spaced-apart rings for engaging the cylinder. In the present invention, the side loads experienced by the pistons 12, 14 are eliminated, or at least minimized. Thus, the side skirts of the pistons 12 and 14 may be reduced substantially relative to conventional designs. The illustrated embodiments show shorter side skirts, but the side skirts may be reduced even further than as illustrated. The minimum side skirt length may depend on the length necessary for sufficient piston rings.

Figure 7:
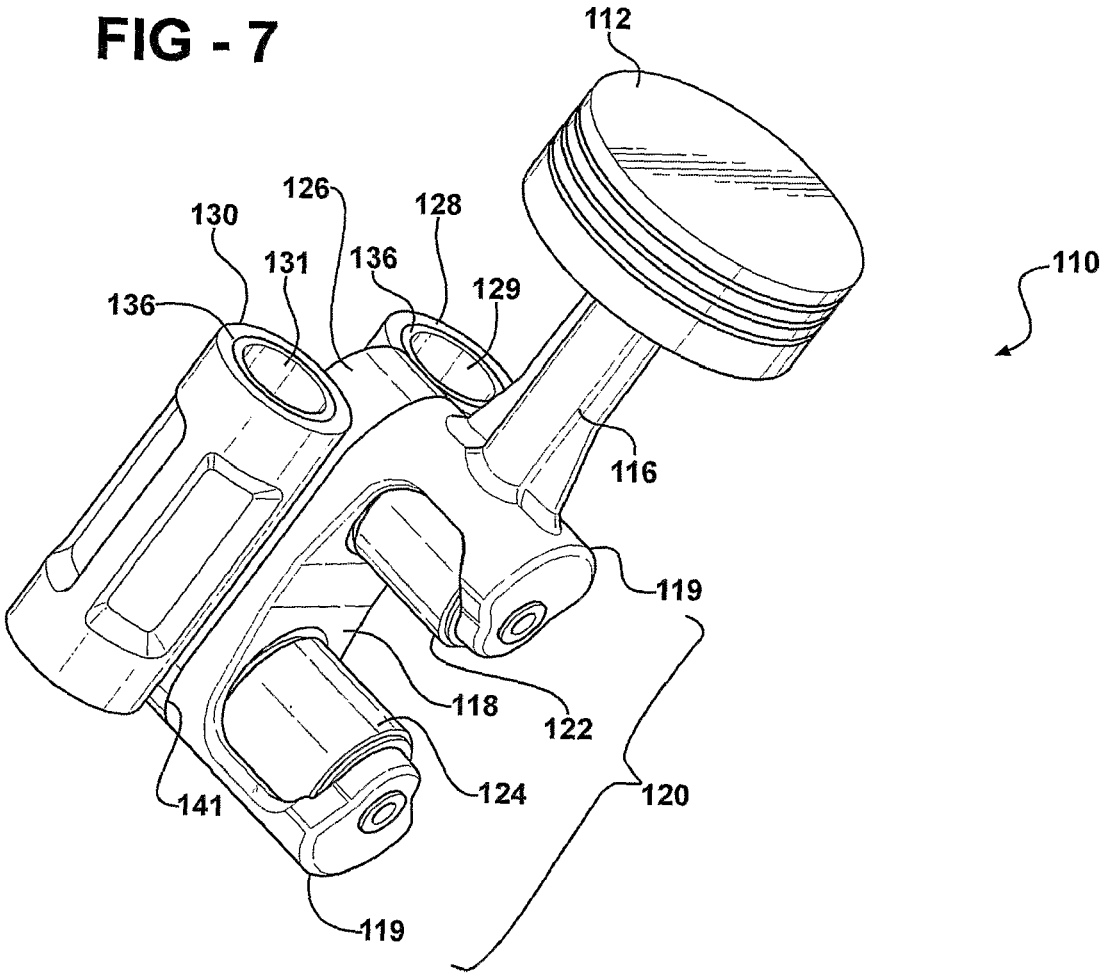
FIG. 7 is a perspective view of a single-ended piston assembly according to a second embodiment of the invention.

Referring to FIG. 7, a piston assembly according to a second embodiment of the invention is shown at 110, wherein like parts are indicated by like numerals offset by 100. The piston assembly 110 is similar to the previous embodiment of FIG. 1, except that it includes a single piston 112 and a single connecting rod 116 extending between the bridge structure 120 and the piston 112.

Figure 8:
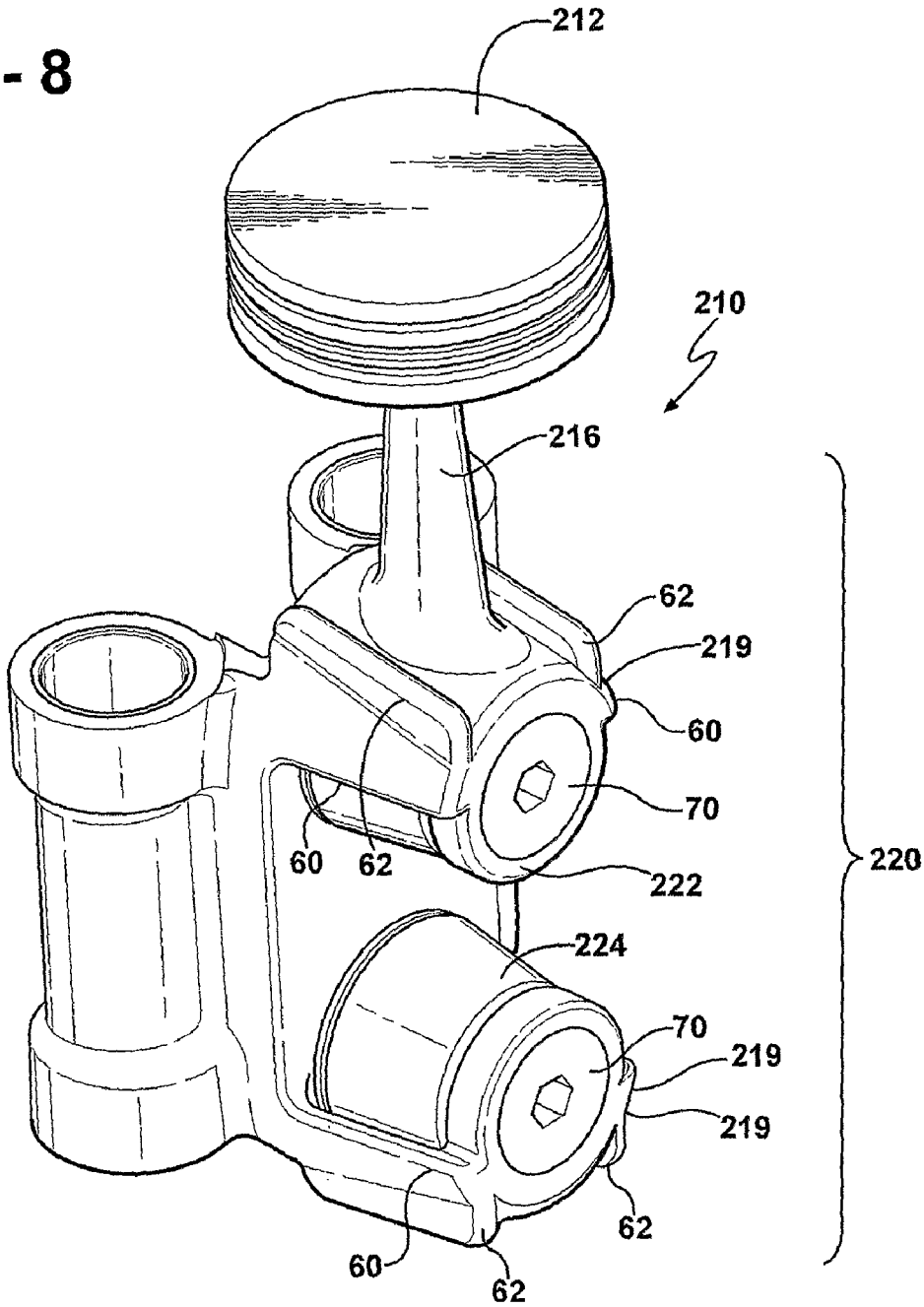
FIG. 8 is a top perspective view of a piston assembly according to a third embodiment of the invention.
Figure 9:
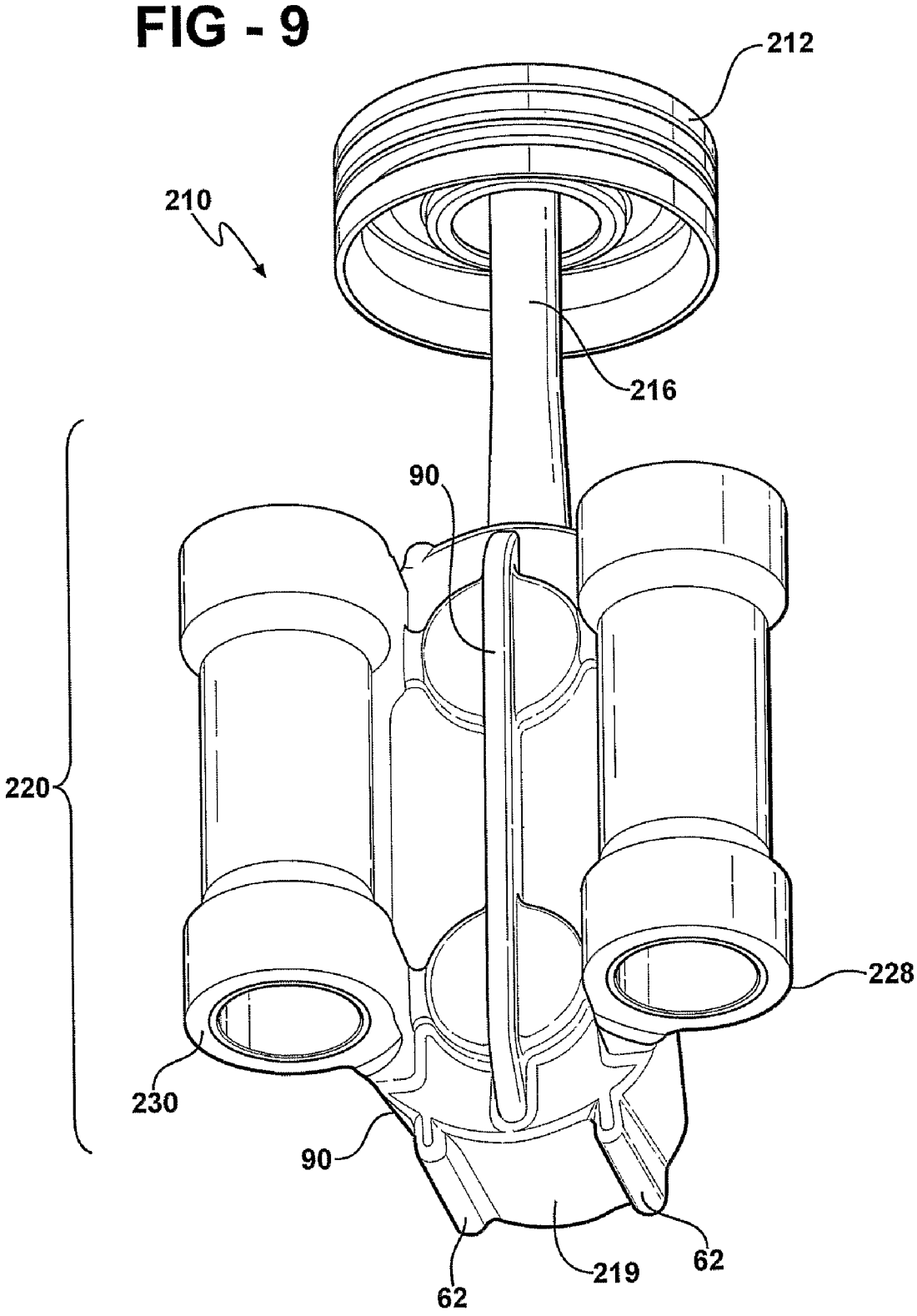
FIG. 9 is a bottom perspective view of the piston assembly according to the third embodiment of the invention.
Figure 10:
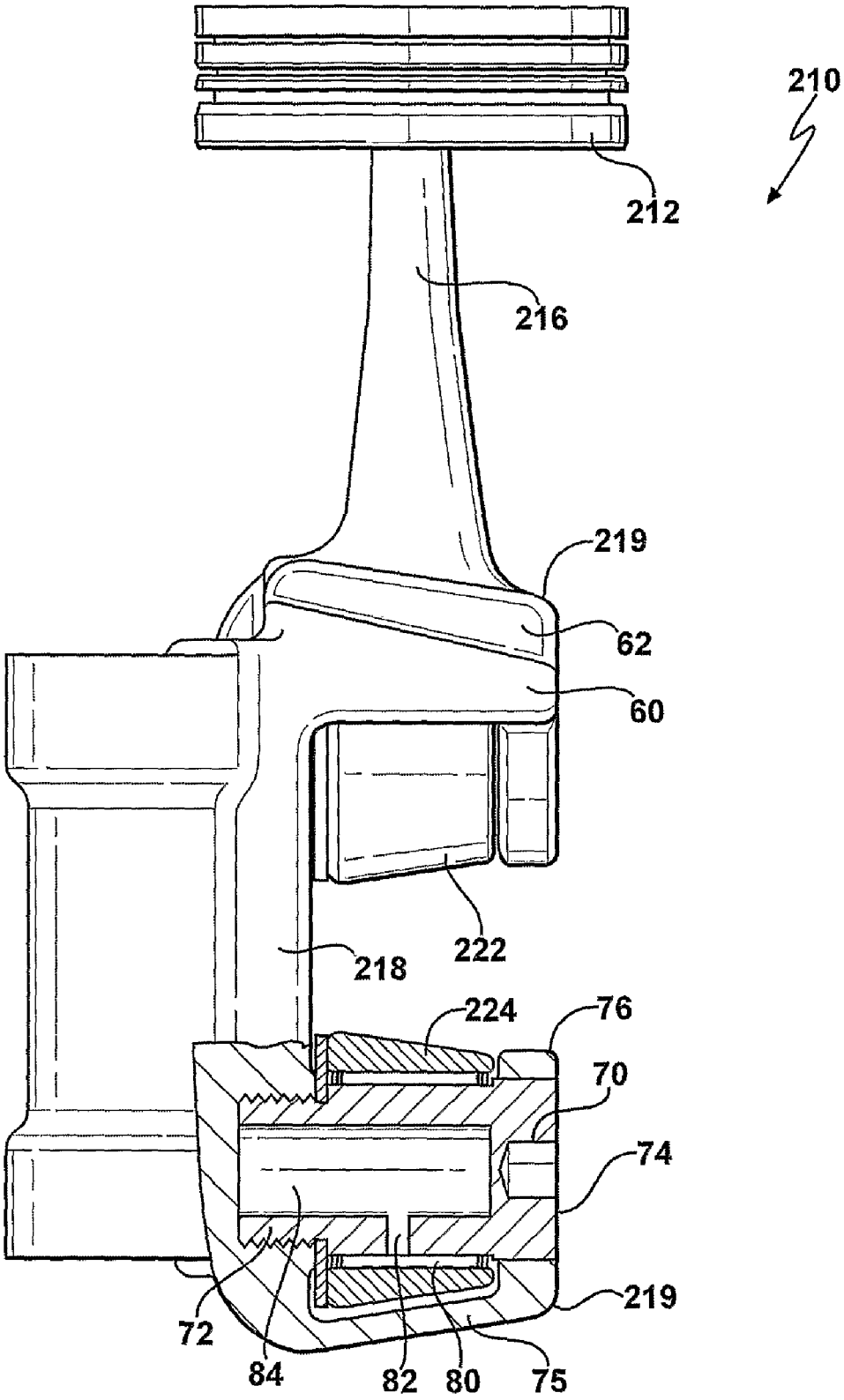
FIG. 10 is a side elevational view of the piston assembly according to the third embodiment of the invention with a portion cut away to show the tapered roller bearing.

Referring to FIGS. 8-10, a piston assembly according to a third embodiment of the invention is shown at 210. The piston assembly 210 in this embodiment includes a bridge structure 220 that is stronger relative to the bridge structure 20 of the first embodiment in FIG. 1. More specifically, each bearing 222, 224 is rotatably coupled to the bearing support 219 by a pivot pin 70 having opposite proximal 72 and distal 74 ends. One end 72 of each pin 70 is threaded into the center portion 218 of the bridge structure 220, or it may be fixedly secured to the center portion by being threaded or bonded, by being welded or using other securing methods known to those of skill in the art. An outer wall 76 of each bearing support 219 is spaced apart and generally parallel with the center portion 218 to support the opposite end 74 of the pin 70. In one version, the outer or opposite end 74 is received in a hole that supports the end 74. The end 74 may have a head or enlarged portion that is received in a recess. Alternatively, the opposite end 74 of the pin 70 may be fixedly secured to the outer wall 76 by being threaded or bonded, by being welded or using other securing methods known by those skilled in the art. As yet a further alternative, the inner end 72 may be merely supported by the center portion, without threading or bonding, while the outer end 74 is threaded or is otherwise fixedly secured to the outer wall 76. An end wall 75 interconnects the center portion 218 and the outer wall 76. A transverse flange 60 and an upstanding flange 62 extend along the end wall 75 between the center portion 18 and the outer wall 76 of the bearing support 219. Two flanges 60, 62 are showing though one or more than two may be provided. The transverse 60 and upstanding 62 flanges are generally orthogonal relative to each other. By this arrangement, the end wall 75 reinforced by the flanges 60, 62, the outer wall 76 of the bearing support 219, the center portion 218 and the pivot pin 70 form a rigid, close-ended structure that resists bending of the bearing support 219 relative to the center portion 218. As best shown in the cut-away view of FIG. 10, the end wall 75 is oriented along a line that converges toward the axis of the pin 70, so that the close-ended structure has a generally triangulated shape. As shown in FIG. 9, a reinforcing rib 90 is integrally formed along a side of the bridge structure 220 opposite the bearing supports 219. The rib 90 is positioned between the guide rod bearing supports 228, 230. The rib 90 extends longitudinally along a line generally parallel with the bearing supports 228, 230. More or fewer ribs than illustrated may be used and their sizes and orientations may be changed.

The piston assembly 210 also utilizes bearings 222, 224 that are frustoconically shaped. This shape provides better rolling of the bearings 222, 224 along the upper 37 and lower 39 surfaces of the cam plate 34.

An annular space 80 is defined between each bearing 222, 224 and pin 70. Oil is disposed in the annular space 80 to lubricate the interface between the bearing 222, 224 and pin 70. Oil is delivered to the annular space 80 via a feed line 82 in fluid communication between an oil reservoir 84 defined in the pin 70 and the annular space 80. Pressurized oil is supplied to the reservoir by feed lines 82 that extend through the bridge structure 218 and are in communication with feed lines in the guide rods, as described in the first embodiment. Alternatively, a mechanical bearing or combination thereof with oil may be disposed in the annular space to minimize friction between the bearing 222, 224 and pin 70.

The piston assembly 210 is shown illustratively for a single ended barrel engine. It should be readily appreciated by those skilled in the art that the piston assembly 210 according to the third embodiment may also include a second piston and second connecting rod for use in a double ended barrel engine, similar to the first embodiment of FIG. 1.

It should be appreciated by those having ordinary skill in the art that the invention as described herein may be used in a variety of barrel engine types, such spark ignition, diesel, HCCI or any combination thereof. The invention may be used in combination with any of the technologies as disclosed in U.S. Pat. Nos. 6,662,775; 6,899,065; 6,986,342; 6,698,394; 6,834,636, and U.S. patent application Ser. Nos. 10/997,443; 11/255,804; 11/360,779; 60/773,263; 60/721,853; 60/774,982; 60/774,343; 60/774,344; 60/774,982; 60/774,411; 60/773,109; 60/774,410; 60/774,856; 60/773,090; 60/773,936; 60/773,233; 60/773,234, all of which are incorporated herein by reference in their entirety.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

We claim:

1. A barrel engine comprising:

a drive shaft;

an undulating cam plate interconnected to the drive shaft for rotation therewith;

a plurality of cylinders, each having a longitudinal axis that is generally parallel with the drive shaft, the axes of the cylinders being arranged in a generally circular manner about the drive shaft;

a pair of guide rods corresponding to each cylinder of the engine, each rod having an outer surface extending longitudinally along an axis generally parallel with the axes of the cylinders; and a plurality of piston assemblies each comprising;

a piston head slidably coupled to one of the cylinders for reciprocal movement along the axis of the cylinder;

a guide block operatively coupled to the cam plate to cause axial displacement of the piston head in the cylinder in response to rotation of the cam plate with the drive shaft, the guide block further having a pair of longitudinal bores defined therethrough, the bores having inner walls, each of the bores slidably receiving the guide rod therethrough for guiding the piston head during reciprocal movement along the axis of the cylinder, each inner wall being spaced apart from the outer surface of a respective guide rod to define an oil reservoir therebetween, the oil reservoir extending generally continuously between opposite ends of the guide block.

2. A barrel engine, as set forth in claim 1, including a pair of bushings disposed at opposite ends of each bore for reducing friction between the guide block and guide rods.

3. A barrel engine as set forth in claim 2, wherein the oil reservoir is substantially enclosed between the pair of bushings.

4. A barrel engine as set forth in claim 3, wherein the reservoir is generally annular shaped and extends continuously in an axial direction between the pair of bushings.

5. A barrel engine as set forth in claim 1, wherein at least one of the guide rods includes an outlet defined therethrough to deliver oil to the reservoir.

6. A barrel engine as set forth in claim 5, wherein the outlet remains in continuous fluid communication with the reservoir during reciprocal movement of the piston assembly along the guide rods.

7. A barrel engine as set forth in claim 6, including a pair of bushings disposed at opposite ends of each guide bore for reducing friction between the guide block and guide rods, the outlet remaining between the pair of bushings during the reciprocal movement of the piston assembly along the guide rods.

8. A barrel engine as set forth in claim 7, wherein the reservoirs are annular shaped.

9. A barrel engine as set forth in claim 1, wherein the guide rods are spaced apart radially outwardly relative to the cylinders.

10. A barrel engine as set forth in claim 1 including a pair of roller bearing pivotally coupled to the guide block for rolling engagement with opposite sides of the cam plate.

11. A barrel engine as set forth in claim 10, wherein the roller bearings are generally frustoconically shaped.

12. A piston assembly for use in a barrel internal combustion engine having a central drive shaft, an undulating cam plate fixedly secured to the drive shaft for rotation therewith, and a plurality of cylinders radially spaced apart from the drive shaft, said piston assembly comprising:

a piston head configured to be slidably coupled to one of the cylinders for reciprocating axial movement therein; a pair of roller bearings configured to be rollingly engaged with opposite surfaces of the cam plate to cause rotation of the drive shaft in response to the axial movement of the piston head;

a bridge structure having a center portion and a connecting rod extending therefrom to support the piston head, the center portion extending between a pair of spaced apart bearing supports, each bearing support having an outer wall spaced apart from the center portion and an end wall interconnecting the center portion to the outer wall;

a pair of pivot pins each pivotally connecting one of the roller bearings to one of the bearing supports, each pivot pin having one end fixedly secured to the center portion and an opposite end fixedly secured to the outer wall, the pivot pin being a member of a substantially closed-ended structure defined by the center portion, end wall and outer wall to minimize flexing of the bearing support relative to the center portion; and a flange extending along the end wall to reinforce the bearing support.

13. A piston assembly as set forth in claim 12, wherein the flange comprises a pair of flanges extending along the end wall to reinforce the bearing support, the pair of flanges being substantially orthogonal relative to each other.

14. A piston assembly as set forth in claim 12 including a guide block configured to be slidably coupled to guide rods in the engine for guiding the reciprocating axial movement of the piston heads within the cylinders.

15. A piston assembly as set forth in claim 14, wherein the guide block includes a pair of bores defined therethrough, each of the bores configured to slidably receiving the guide rod therethrough for guiding the reciprocating axial movement of the piston heads within the cylinders.

16. A piston assembly as set forth in claim 15, wherein each bore has an inner wall that is spaced apart from the outer surface of a respective guide rod to define an oil reservoir therebetween.

17. A piston assembly as set forth in claim 16, wherein the oil reservoir extends generally continuously between opposite ends of the guide block.

18. A piston assembly as set forth in claim 17 including a pair of bushings disposed at opposite ends of each guide bore.

19. A piston assembly as set forth in claim 18, wherein the oil reservoir is generally annular shaped and extends continuously in an axial direction between the pair of bushings.

20. A piston assembly as set forth in claim 17, wherein the pair of bushings remain on opposite sides of an oil outlet formed in the guide rod during the reciprocating axial movement of the piston heads within the cylinders.

21. A piston assembly for use in a barrel internal combustion engine having a central drive shaft, an undulating cam plate fixedly secured to the drive shaft for rotation therewith, and a plurality of cylinders radially spaced apart from the drive shaft, said piston assembly comprising:

a piston head configured to be slidably coupled to one of the cylinders for reciprocating axial movement therein; a pair of roller bearings configured to be rollingly engaged with opposite surfaces of the cam plate to cause rotation of the drive shaft in response to the axial movement of the piston head:

a bridge structure having a center portion and a connecting rod extending therefrom to support the piston head, the center portion extending between a pair of spaced apart bearing supports, each bearing support having an outer wall spaced apart from the center portion and an end wall interconnecting the center portion to the outer wall; and a pair of pivot pins each pivotally connecting one of the roller bearings to one of the bearing supports, each pivot pin having one end fixedly secured to the center portion and an opposite end fixedly secured to the outer wall, the pivot pin being a member of a substantially closed-ended structure defined by the center portion, end wall and outer wall to minimize flexing of the bearing support relative to the center portion;

wherein the end wall extends along a line that converges toward a longitudinal axis of the pivot pin.

22. A barrel engine comprising:

a drive shaft;

an undulating cam plate interconnected to the drive shaft for rotation therewith; a plurality of cylinders, each having a longitudinal axis that is generally parallel with the drive shaft, the axes of the cylinders being arranged in a generally circular manner about the drive shaft;

a pair of guide rods corresponding to each cylinder of the engine, each rod having an outer surface extending longitudinally along an axis generally parallel with the axes of the cylinders; and a plurality of piston assemblies each comprising:

a piston head slidably coupled to one of the cylinders for reciprocal movement along the axis of the cylinder;

a pair of roller bearings rollingly engaged with opposite surfaces of the cam plate to cause rotation of the drive shaft in response to the axial movement of the piston head;

a bridge structure having a center portion and a connecting rod extending therefrom to support the piston head, the center portion extending between a pair of spaced apart bearing supports, each bearing support having an outer wall spaced apart from the center portion and an end wall interconnecting the center portion to the outer wall;

a pair of pivot pins each pivotally connecting one of the roller bearings to one of the bearing supports, each pivot pin having one end fixedly secured to the center portion and an opposite end supported by the outer wall, the pivot pin being a member of a substantially closed-ended structure defined by the center portion, end wall and outer wall to minimize flexing of the bearing support relative to the center portion; and a guide block interconnected to the bridge structure, the guide block further having a pair of bores defined therethrough, each of the bores slidably receiving one of the guide rods therethrough for guiding the piston head during reciprocal movement along the axis of the cylinder, each bore having an inner wall being spaced apart from the outer surface of a respective guide rod to define an oil reservoir therebetween, the oil reservoir extending generally continuously between opposite ends of the guide block.

23. A barrel engine, as set forth in claim 22, including a pair of bushings disposed at opposite ends of each guide bore for reducing friction between the guide block and guide rods.

24. A barrel engine as set forth in claim 23, wherein the oil reservoir is substantially enclosed between the pair of bushings.

25. A barrel engine as set forth in claim 24, wherein the reservoir is generally annular shaped and extends continuously in an axial direction between the pair of bushings.

26. A barrel engine as set forth in claim 22, wherein at least one of the guide rods includes an outlet defined therethrough to deliver oil to the reservoir.

27. A barrel engine as set forth in claim 26, wherein the outlet remains in continuous fluid communication with the reservoir during reciprocal movement of the piston assembly along the guide rods.

28. A barrel engine as set forth in claim 27, including a pair of bushings disposed at opposite ends of each guide bore for reducing friction between the guide block and guide rods, the outlet remaining between the pair of bushings during the reciprocal movement of the piston assembly along the guide rods.

29. A barrel engine as set forth in claim 28, wherein the end wall is angled relative to roller axis such that the end wall, outer wall, pin and cetern portion form a triangulated structure.

30. A barrel engine comprising:

a drive shaft;

an undulating cam plate interconnected to the drive shaft for rotation therewith;

a plurality of cylinders, each having a longitudinal axis that is generally parallel with the drive shaft, the axes of the cylinders being arranged in a generally circular manner about the drive shaft;

a pair of guide rods corresponding to each cylinder of the engine, each rod having an outer surface extending longitudinally along an axis generally parallel with the axes of the cylinders; and a plurality of piston assemblies each comprising:

a piston head slidably coupled to one of the cylinders for reciprocal movement along the axis of the cylinder;

a bridge structure having a center portion and a connecting rod extending therefrom to support the piston head, the center portion extending between a pair of spaced apart bearing supports, each bearing support having an outer wall generally parallel with the center portion and an end wall interconnecting the center portion to the outer wall;

pair of roller bearings each supported by one of the bearing supports of the bridge structure, the roller bearings each being rollingly engaged with opposite surfaces of the cam plate to cause rotation of the drive shaft in response to the axial movement of the piston head; and a guide block interconnected to the bride structure, the guide block further having a pair of bores defined therethru, each of the bores slidably receiving one of the guide rods for guiding the piston head during reciprocal movement along the axis of the cylinder, each bore having an inner wall spaced apart from the outer surface of a respective guide rod to define an oil reservoir therebetween;

wherein at least one of the guide rods in pair having an oil passage with an opening defined in the outer surface for providing oil to the oil reservoir, the guide block and bride structure further having oil passages defined therein for providing oil from the reservoir to the roller bearings.

31. A barrel engine as set forth in claim 30, wherein the bridge structure further includes an oil passage defined therein for providing oil to the piston head.

32. A barrel engine as set forth in claim 31, wherein the bridge structure sprays oil on piston head.

33. A barrel engine as set forth in claim 30 including a pair of pivot pins each pivotally connecting one of the roller bearings to one of the bearing supports, each pivot pin having one end fixedly secured to the center portion and an opposite end fixedly secured to the outer wall, the pivot pin being a member of a substantially closed-ended structure defined by the center portion, end wall and outer wall to minimize flexing of the bearing support relative to the center portion.

34. A piston assembly for use in a barrel internal combustion engine having a central drive shaft, an undulating cam plate fixedly secured to the drive shaft for rotation therewith, and a plurality of cylinders radially spaced apart from the drive shaft, said piston assembly comprising:

a piston head configured to be slidably coupled to one of the cylinders for reciprocating axial movement therein;

a bridge structure operatively coupled to the undulating cam plate so as to translate the reciprocating axial movement of the piston head into rotational movement of the drive shaft, the bridge structure having a center portion and a connecting rod extending therefrom to support the piston head, the center portion extending between a pair of spaced apart bearing supports, the bridge structure being formed with a frangible parting line to allow subsequent separation of the bridge structure into at least two pieces, which are configured to be subsequently reassembled to each other during assembly of the engine.

35. A piston assembly as set forth in claim 34 including a pair of roller bearings pivotally coupled to the pair of bearing supports, the bearing supports being spaced apart so the roller bearings are rollingly engaged with opposite surfaces of the cam plate to cause rotation of the drive shaft in response to the reciprocating axial movement of the piston head.

36. A piston assembly as set forth in claim 34, wherein the parting line is disposed between the bearing supports, so that the bearing supports are separate from each other after cracking of the bridge structure along the parting line.

37. A piston assembly as set forth in claim 34, wherein the bridge structure includes a guide block for guiding the reciprocating axial movement of the piston, the parting line extending through the guide block for separation thereof after cracking of the bridge structure along the parting line.

38. A method of assembling a barrel internal combustion engine, said method comprising the steps of: providing an engine block;

pivotally coupling a center drive shaft to the engine block;

fixedly securing an undulating cam plate to the center drive shaft;

providing a piston assembly as set forth in claim 35;

cracking the bridge structure along the parting line to divide the bridge structure into at least two separate pieces.

39. A method as set forth in claim 38 including the step of cracking the bridge structure along the parting line between the bearing supports so that the bearing supports are separate from each other.

40. A method as set forth in claim 39 including the step of assembling the at least two separate pieces of the bridge structure to the engine, such that one of the bearing supports is engaged with one side of the cam plate.

41. A method as set forth in claim 40 including the step of assembling the other of the at least two separate pieces of the bridge structure to the engine, such that the other of the bearing supports is engaged with an opposite side of the cam plate.

42. A method as set forth in claim 41 including the step of adjusting the relative positions of the at least two separate pieces during assembly so as to accommodate build tolerances in the engine.

* * * * *

UNITED STATES PATENT AND TRADEMARK OFFICE

CERTIFICATE OF CORRECTION

PATENT NO. : 8,015,956 B2
APPLICATION NO. : 11/916624
DATED : September 13, 2011
INVENTOR(S) : Randall R. Gaiser et al.

It is certified that error appears in the above-identified patent and that said Letters Patent is hereby corrected as shown below:

Col. 12, line 12, claim 30: replace “bride” with --bridge--;

Col. 12, line 23, claim 30: replace “bride” with --bridge--.

Signed and Sealed this
Twenty-first Day of February, 2012

David J. Kappos

David J. Kappos
*Director of the United States Patent and Trademark Office*